US008261726B2

(12) United States Patent
Hassan et al.

(10) Patent No.: US 8,261,726 B2
(45) Date of Patent: Sep. 11, 2012

(54) HIGH SHEAR PROCESS FOR AIR/FUEL MIXING

(75) Inventors: Abbas Hassan, Sugar Land, TX (US); Rayford G. Anthony, College Station, TX (US); Gregory Borsinger, Chatham, NJ (US); Aziz Hassan, Sugar Land, TX (US); Ebrahim Bagherzadeh, Sugar Land, TX (US)

(73) Assignee: H R D Corporation, Houston, TX (US)

( * ) Notice: Subject to any disclaimer, the term of this patent is extended or adjusted under 35 U.S.C. 154(b) by 525 days.

(21) Appl. No.: 12/476,743

(22) Filed: Jun. 2, 2009

(65) Prior Publication Data

US 2010/0000502 A1 Jan. 7, 2010

Related U.S. Application Data

(60) Provisional application No. 61/078,154, filed on Jul. 3, 2008.

(51) Int. Cl.
*F02M 29/00* (2006.01)

(52) U.S. Cl. ..... 123/590; 261/83

(58) Field of Classification Search ..... 123/26, 123/585, 590, 592; 261/83; 366/241
See application file for complete search history.

(56) References Cited

U.S. PATENT DOCUMENTS 3,630,498 A * 12/1971 Bielinski ..... 261/87
5,538,191 A 7/1996 Holl
5,877,350 A 3/1999 Langer et al.
6,368,366 B1 4/2002 Langer et al.
6,368,367 B1 4/2002 Langer et al.
6,383,237 B1 5/2002 Langer et al.
6,530,964 B2 3/2003 Langer et al.
6,742,774 B2 * 6/2004 Holl ..... 261/83
2002/0089074 A1 7/2002 Holl
2003/0043690 A1 3/2003 Holl
2004/0052158 A1 3/2004 Holl
2004/0068063 A1 4/2004 Cornelis Bleijenberg et al.
2005/0033069 A1 2/2005 Holl et al.
2006/0245991 A1 11/2006 Holl et al.

FOREIGN PATENT DOCUMENTS

DE 29713519 U1 * 10/1997
DE 19731456 A1 * 2/1999
JP 06-315617 A 11/1994
JP 2000146152 A * 5/2000
JP 2002-508238 A 3/2002
WO 99/30812 A1 6/1999

OTHER PUBLICATIONS

Written Opinion of PCT/US2009/045988, form PCT/ISA/237, 4 pages, mailed on Jan. 12, 2010.*
International Application No. PCT/US2009/045988 International Search Report dated Jan. 12, 2010.
Patent Abstracts of Japan for Japanese Publication No. 06-315-617 (2 pgs.).
Gogate, et al "Cavitation: A Technology on the Horizon", Current Science vol. 91 (No. 1) 35-46 (2006).
IKA-Rotor-Stator Generators—2003 Processing Catalog (38 pgs.).

* cited by examiner

*Primary Examiner* — Noah Kamen
(74) *Attorney, Agent, or Firm* — Timothy S. Westby; Porter Hedges LLP

(57) ABSTRACT

Use of a high shear mechanical device in a process to produce aerated fuels for efficient combustion in an engine. In instances, the method comprises forming an emulsion of a gas and liquid fuel in a high shear device prior to introduction to an engine. A vehicular system for producing aerated fuels comprising a high shear device.

16 Claims, 2 Drawing Sheets

HIGH SHEAR PROCESS FOR AIR/FUEL MIXING

CROSS-REFERENCE TO RELATED APPLICATIONS

This application claims benefit of U.S. Provisional Application Ser. No. 61/078,154 filed on Jul. 3, 2008, entitled "High Shear Process for Air/Fuel Mixing," incorporated herein by reference in its entirety for all purposes.

STATEMENT REGARDING FEDERALLY SPONSORED RESEARCH OR DEVELOPMENT

Not Applicable.

BACKGROUND OF THE INVENTION

1. Technical Field

The present disclosure relates generally to internal combustion engines. More specifically, the disclosure relates to operation of an internal combustion engine.

2. Background of the Invention

The volatile market for oil and oil distillates affects the cost of fuels to consumers. The increase costs may manifest as increased costs for kerosene, gasoline, and diesel. As demand and prices increase, consumers seek improved efficiency from their internal combustion engines. Engine efficiency, as it relates to fuel consumption, typically involves a comparison of the total chemical energy in the fuels and the useful energy abstracted from the fuels in the form of kinetic energy. The most fundamental concept of engine efficiency is the thermodynamic limit for abstracting energy from the fuel defined by a thermodynamic cycle. The most comprehensive and economically important concept is the empirical fuel economy of the engine, for example miles per gallon in automotive applications.

Internal combustion engines, such as those found in automobiles, are engines in which fuel and an oxidant are mixed and combusted in a combustion chamber. Typically, these engines are four-stroke engines. The four-stroke cycle comprises an intake, compression, combustion, and exhaust strokes. The combustion reaction produces heat and pressurized gases that are permitted to expand. The expansion of the product gases acts on mechanical parts of the engine to produce useable work. The product gases have more available energy than the compressed fuel/oxidant mixture. Once available energy has been removed, the heat not converted to work is removed by a cooling system as waste heat.

Unburned fuel is vented from the engine during the exhaust stroke. In order to achieve nearly complete combustion, it is necessary to operate the engine near the stoichiometric ratio of fuel to oxidant. Although this reduces the amount of unburned fuel, it also increases emissions of certain regulated pollutants. These pollutants may be related to the poor mixture of the fuel and oxidant prior to introduction to combustion chamber. Further, operation near the stoichiometric ratio increases the risk of detonation. Detonation is a hazardous condition where the fuel auto-ignites in the engine prior to the completion of the combustion stroke. Detonation may lead to catastrophic engine failure. In order to avoid these situations, the engine is operated with an excess of fuel.

Accordingly, there is a need in the industry for improved methods of mixing fuel and oxidants prior to injection into internal combustion engines.

SUMMARY OF THE INVENTION

A high shear system and process for aerated fuel production is disclosed. The method for forming the emulsion comprising: obtaining a high shear device having at least one rotor/stator set configured for producing a tip speed of at least 5 m/s, introducing gas and a liquid fuel into said high shear device, and forming an emulsion of gas and liquid fuel, wherein said gas comprises bubbles with an average diameter less than about 5 μm.

In an embodiment described in the present disclosure, a process employs a high shear mechanical device to provide enhanced time, temperature, and pressure conditions resulting in improved dispersion of multiphase compounds.

These and other embodiments, features, and advantages will be apparent in the following detailed description and drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Overview

The present disclosure provides a system and method for the production of aerated fuel comprising mixing liquid fuels and oxidant gas with a high shear device. The system and method employ a high shear mechanical device to provide rapid contact and mixing of reactants in a controlled environment in the reactor/mixer device, prior to introduction to an internal combustion engine. The high shear device thoroughly distributes the oxidant gases through the liquid fuel to improve combustion. In certain instances, the system is configured to be transportable.

Chemical reactions and mixtures involving liquids, gases, and solids rely on the laws of kinetics that involve time, temperature, and pressure to define the rate of reactions and thoroughness of mixing. Where it is desirable to combine two or more raw materials of different phases, for example solid and liquid; liquid and gas; solid, liquid and gas, in an emulsion, one of the limiting factors controlling the rate of reaction and thoroughness of mixing is the contact time of the reactants. Not to be limited by a specific theory, it is known in emulsion chemistry that sub-micron particles, globules, or bubbles, dispersed in a liquid undergo movement primarily through Brownian motion effects in diffusion.

Mixing oxidants and fuels prior to combustion comprises the additional risk of explosion. The explosive limit in air is measured by percent by volume at room temperature. The Upper Explosive Limit, hereinafter UEL, parameter represents the maximum concentration of gas or vapor above which the substance will not burn or explode because above this concentration there is not enough oxidant to ignite the fuel. The Lower Explosive Limit, hereinafter LEL, parameter represents the minimum concentration of gas or vapor in the air below which the substance will not burn or explode because below this threshold there is insufficient fuel to ignite. Mixtures of fuel and oxidant between these limits are at an increased risk of explosion. For combustion, or an explosion, to occur there are three elements combined in a suitable ratio: a fuel, an oxidant, and an ignition source. In certain instances, the ignition source may comprise a spark, a flame, high pressure, or other sources without limitation. Regulation of the oxidant/fuel mixture, conditions, and container comprise possible means to mitigate the explosion risk.

For gasoline, the LEL is about 1.4% by volume and UEL is about 7.6% by volume. With diesel, the explosion risk is reduced, compared to gasoline. This is due to diesel's higher flash point, which prevents it from readily evaporating and producing a flammable aerosol. The LEL for diesel fuel is about 3.5% by volume and the UEL is about 6.9% by volume. Maintaining fuel mixtures, such as gasoline or diesel, below the LEL, and above the UEL is important to reduce the risk of explosion.

High Shear Fuel System

Figure 1:
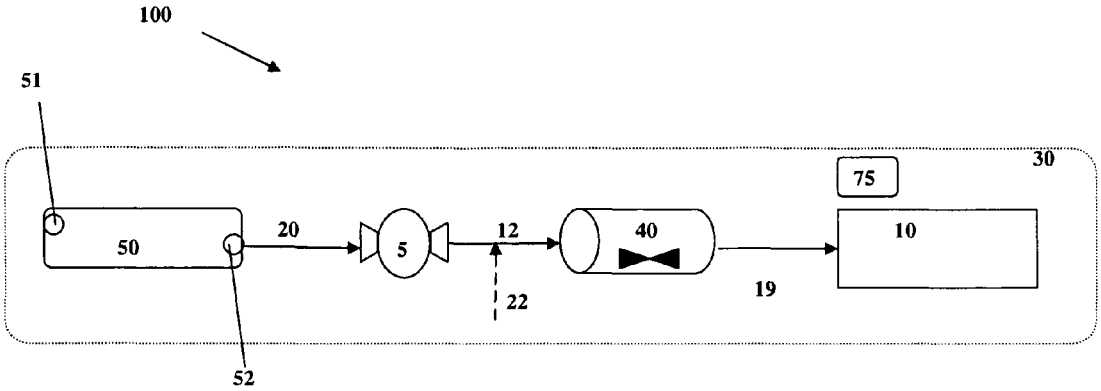
FIG. 1 is a schematic of a High Shear Fuel System according to an embodiment of the disclosure.

As illustrated in FIG. 1, high shear fuel system (HSFS) 100 comprises vessel 50, pump 5, high shear device 40, and engine 10. HSFS 100 is disposed with a vehicle 30. Vehicle 30 comprises a car, truck, tractor, train, or other transportation vehicle without limitation. Alternatively, vehicle 30 may comprise a movable, portable, or transportable engine, for instance a generator. Vehicle 30 is driven by or powered by engine 10. Engine 10 comprises an internal combustion engine. In certain embodiments, engine 10 comprises a diesel or gasoline engine. Alternatively, engine 10 may comprise any engine that operates by the combustion of any fuels with an oxidant, for instance kerosene or a propane engine, without limitation.

Fuels are stored in vessel 50. Vessel 50 is configured for the storage, transportation, and consumption of liquid fuels. Vessel 50 comprises at least two openings, an inlet 51 and an outlet 52. Vessel 50 is accessible from the exterior of vehicle 30 for refilling via inlet 51. Vessel 50 is in fluid communication with engine 10 via at least outlet 52. In certain instances vessel 50 comprises a fuel tank, or fuel cell. In certain instances, vessel 50 may be pressurized. Alternatively, vessel 50 may be configured to store gaseous fuels.

Outlet 52 is coupled to fuel line 20 directed to pump 5. Pump 5 is configured for moving fuel from vessel 50 to engine 10. In embodiments, pump 5 is in fluid communication with vessel 50 and engine 10. Pump 5 is configured for pressurizing fuel line 20, to create pressurized fuel line 12. Pump 5 is in fluid communication with pressurized fuel line 12. Further, pump 5 may be configured for pressurizing HSFS 100, and controlling fuel flow therethrough. Pump 5 may be any fuel pump configured for moving fuel to a combustion engine as known to one skilled in the art. Alternatively, pump 5 may comprise any suitable pump, for example, a Roper Type 1 gear pump, Roper Pump Company (Commerce Georgia) or Dayton Pressure Booster Pump Model 2P372E, Dayton Electric Co (Niles, Ill.). In certain instance pump 5 is resistant to corrosion by fuel. Alternatively, all contact parts of pump 5 comprise stainless steel.

Pump 5 increases the pressure of the fuel in fuel line 20 to greater than about atmospheric pressure, 101 kPa (1 atm); preferably the pump 5 increases pressure to 203 kPA (2 atm), alternatively, greater than about 304 kPA (3 atm). Pump 5 builds pressure and feeds high shear device 40 via pressurized fuel line 12.

Pressurized fuel line 12 drains pump 5. Pressurized fuel line 12 further comprises oxidant feed 22. Oxidant feed 22 is configured to inject oxidants into pressurized fuel line 12. Oxidant feed 22 may comprise a compressor or pump for injecting oxidants into pressurized fuel line 12. Oxidant feed 22 comprises air. Oxidant feed 22 may comprise fuel additives or alternative reactants for combustion, or for emissions control. Further, oxidant feed 22 may comprise a means to vaporize the fuel additives for introduction into pressurized fuel line 12. For example, oxidant feed 22 may comprise water, methanol, ethanol, oxygen, nitrous oxide, or other compounds known to one skilled in the art for improving the efficiency of combustion, emissions, and other engine 10 operation parameters without limitation. Pressurize fuel line 12 is further configured to deliver fuel and oxidant to HSD 40. Pressurized fuel line 12 is in fluid communication with HSD 40. Oxidant feed 22 is in fluid communication with HSD 40 via pressurized fuel line 12. Alternatively, oxidant feed 22 is in direct fluid communication with HSD 40.

HSD 40 is configured to mix oxidant feed 22 and fuel in pressurized fuel line 12, intimately. As discussed in detail below, high shear device 40 is a mechanical device that utilizes, for example, a stator-rotor mixing head with a fixed gap between the stator and rotor. In HSD 40, the oxidant gas and fuel are mixed to form an emulsion comprising microbubbles and nanobubbles of the oxidant gas. In embodiments, the resultant dispersion comprises bubbles in the submicron size. In embodiments, the resultant dispersion has an average bubble size less than about 1.5 μm. In embodiments, the mean bubble size is less than from about 0.1 μm to about 1.5 μm. In embodiments, the mean bubble size is less than about 400 nm; more preferably, less than about 100 nm.

HSD 40 serves to create an emulsion of oxidant gas bubbles within fuel injection line 19. The emulsion may further comprise a micro-foam. In certain instances, the emulsion may comprise an aerated fuel, or a liquid fuel charged with a gaseous component. Not to be limited by a specific method, it is known in emulsion chemistry that submicron particles dispersed in a liquid undergo movement primarily through Brownian motion effects. In embodiments, the high shear mixing produces gas bubbles capable of remaining dispersed at atmospheric pressure for at least about 15 minutes. In certain instances, the bubbles are capable of remaining dispersed for significantly longer durations, depending on the bubble size. HSD 40 is in fluid communication with engine 10 by the fuel injection line 19. Fuel injection line 19 is configured for transporting fuel to engine 10 for combustion.

Fuel injection line 19 is configured to deliver the fuel and oxidant emulsion to the engine 10. Fuel injection line 19 is fluidly coupled to HSD 40 and engine 10. Fuel injection line 19 is configured to maintain the emulsion outside of the explosive limits of the fuel, such as below the LEL and above the UEL. Fuel injection line 19 further comprises insulation against flame, sparks, heat, electrical charge, or other potential ignition sources. In certain instance fuel injection line 19 may comprise any components associated with a fuel injection system in a vehicle without limitation, for example, fuel pressure regulators, fuel rails, and fuel injectors.

In the preceding discussion of the HSFS 100, the components and operation of HSFS 100 are monitored and controlled by an on board processor, or engine control unit (ECU) 75. ECU 75 comprises any processor configured for monitoring, sensing, storing, altering, and controlling devices disposed in a vehicle. Furthermore, the ECU 75 may be in electric communication with sensors, solenoids, pumps, relays, switches, or other components, without limitation, as a means to adjust or alter operation of HSFS 100 to alter engine operation parameters. ECU 75 is configured to be capable of controlling the HSD 40 operation, for instance to ensure a safe emulsion of oxidant in fuel.

In an exemplary configuration, HSFS 100 is configured to operate in a diesel vehicle. The HSFS 100 is aerating the diesel at a level above the UEL. Aeration is the process of adding an oxidant gas to the fuel, for example in very small bubbles, so that once injected into the engine the fuel burns more completely.

In HSFS 100, diesel fuel is stored in vessel 50. The diesel is drawn from vessel 50 by pump 5. As pump 5 conducts diesel to the high shear device 40, a negative pressure in fuel line 20 draws fuel from vessel 50. Pump 5 pressurizes the liquid diesel fuel.

As pressurized fuel line 12 exits pump 5; has an oxidant feed 22 introduced, the pressurized fuel line 12 comprises a mixture of an oxidant and a fuel; those are two of the three necessary components for ignition. In this embodiment, the oxidant comprises air. Without being limited by theory, a pressurized liquid is harder to vaporize. Thus, the diesel remains above the UEL, or upper explosive limit. The oxidant and pressurized fuel are subjected to mixing in HSD 40. As the system is under pressure, above the UEL, auto-ignition or an explosion is avoided. Further, the oxidant gas is broken down into microbubbles and nanobubbles and dispersed through out the fuel. The dispersed microbubbles and nanobubbles in the fuel comprise an emulsion. Fuel injection line 19 conducts the emulsion to the engine 10 for combustion.

In engine 10, the emulsion is combusted with additional air drawn from the atmosphere. As the diesel comprises an emulsion of air, it can be injected into the engine in above stoichiometric quantities. Without wishing to be limited by theory, the diesel may burn more completely, and reduce certain regulated pollutant emissions, for example oxides of nitrogen. Further, the diesel emulsion may resist detonation in the engine. Detonation is the ignition of the fuel in the engine prior to the proper point in the four-stroke cycle. Consequently, the diesel emulsion combusts the fuel more fully, improving emissions, output, and efficiency. A high shear fuel system 100 for improving these parameters is made possible by the incorporation of a high shear device 40.

High Shear Device

High shear device(s) 40 such as high shear mixers and high shear mills are generally divided into classes based upon their ability to mix fluids. Mixing is the process of reducing the size of inhomogeneous species or particles within the fluid. One metric for the degree or thoroughness of mixing is the energy density per unit volume that the mixing device generates to disrupt the fluid. The classes are distinguished based on delivered energy density. There are three classes of industrial mixers having sufficient energy density to produce mixtures or emulsions with particle or bubble sizes in the range of 0 to 50 μm consistently.

Homogenization valve systems are typically classified as high-energy devices. Fluid to be processed is pumped under very high pressure through a narrow-gap valve into a lower pressure environment. The pressure gradients across the valve and the resulting turbulence and cavitations act to break-up any particles in the fluid. These valve systems are most commonly used in milk homogenization and may yield an average particle size range from about 0.01 μm to about 1 μm. At the other end of the spectrum are high shear mixer systems classified as low energy devices. These systems usually have paddles or fluid rotors that turn at high speed in a reservoir of fluid to be processed, which in many of the more common applications is a food product. These systems are usually used when average particle, globule, or bubble, sizes of greater than 20 microns are acceptable in the processed fluid.

Between low energy, high shear mixers and homogenization valve systems, in terms of the mixing energy density delivered to the fluid, are colloid mills, which are classified as intermediate energy devices. The typical colloid mill configuration includes a conical or disk rotor that is separated from a complementary, liquid-cooled stator by a closely-controlled rotor-stator gap, which may be in the range of from about 0.025 mm to 10.0 mm. Rotors may preferably be driven by an electric motor through a direct drive or belt mechanism. Many colloid mills, with proper adjustment, may achieve average particle, or bubble, sizes of about 0.01 μm to about 25 μm in the processed fluid. These capabilities render colloid mills appropriate for a variety of applications including colloid and oil/water-based emulsion processing such as preparation of cosmetics, mayonnaise, silicone/silver amalgam, and roofing-tar mixtures.

Figure 2:
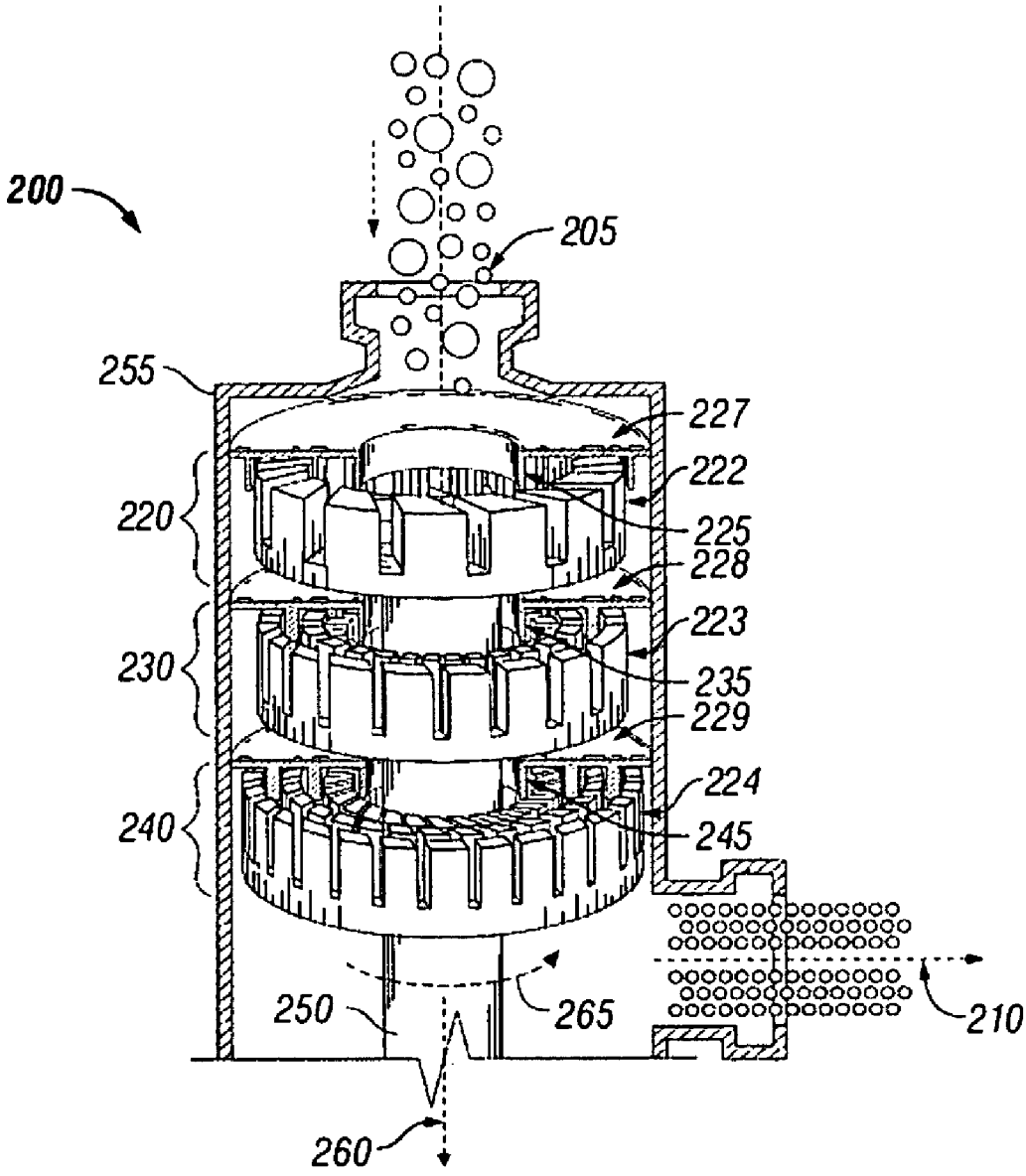
FIG. 2 is a cross-sectional diagram of a high shear device for the production of aerated fuels

Referring now to FIG. 2, there is presented a schematic diagram of a high shear device 200. High shear device 200 comprises at least one rotor-stator combination. The rotor-stator combinations may also be known as generators 220, 230, 240 or stages without limitation. The high shear device 200 comprises at least two generators, and most preferably, the high shear device comprises at least three generators.

The first generator 220 comprises rotor 222 and stator 227. The second generator 230 comprises rotor 223, and stator 228; the third generator comprises rotor 224 and stator 229. For each generator 220, 230, 240 the rotor is rotatably driven by input 250. The generators 220, 230, 240 are configured to rotate about axis 260, in rotational direction 265. Stator 227 is fixably coupled to the high shear device wall 255. For example, the rotors 222, 223, 224 may be conical or disk shaped and may be separated from a complementarily shaped stator 227, 228, 229. In embodiments, both the rotor and stator comprise a plurality of circumferentially spaced rings having complementarily-shaped tips. A ring may comprise a solitary surface or tip encircling the rotor or the stator. In embodiments, both the rotor and stator comprise a more than two circumferentially-spaced rings, more than three rings, or more than four rings. For example, in embodiments, each of three generators comprises a rotor and stator having three complementary rings, whereby the material processed passes through nine shear gaps or stages upon traversing HSD 200. Alternatively, each of the generators 220, 230, 240 may comprise four rings, whereby the processed material passes through twelve shear gaps or stages upon passing through HSD 200. Each generator 220, 230, 240 may be driven by any suitable drive system configured for providing the necessary rotation.

The generators include gaps between the rotor and the stator. In some embodiments, the stator(s) are adjustable to obtain the desired shear gap between the rotor and the stator of each generator (rotor/stator set). The first generator 220 comprises a first gap 225; the second generator 230 comprises a second gap 235; and the third generator 240 comprises a third gap 245. The gaps 225, 235, 245 are between about 0.025 mm (0.01 in) and 10.0 mm (0.4 in) wide. Alternatively, the process comprises utilization of a high shear device 200 wherein the gaps 225, 235, 245 are between about 0.5 mm (0.02 in) and about 2.5 mm (0.1 in). In certain instances, the gap is maintained at about 1.5 mm (0.06 in). Alternatively, the gaps 225, 235, 245 are different between generators 220, 230, 240. In certain instances, the gap 225 for the first generator 220 is greater than about the gap 235 for the second generator 230, which is greater than about the gap 245 for the third generator 240.

Additionally, the width of the gaps 225, 235, 245 may comprise a coarse, medium, fine, and super-fine characterization. Rotors 222, 223, and 224 and stators 227, 228, and 229 may be toothed designs. Each generator may comprise two or more sets of rotor-stator teeth, as known in the art. Rotors 222, 223, and 224 may comprise a number of rotor teeth circumferentially spaced about the circumference of each rotor. Stators 227, 228, and 229 may comprise a number of stator teeth circumferentially spaced about the circumference of each stator. In further embodiments, the rotor and stator may have an outer diameter of about 6.0 cm for the rotor, and about 6.4 cm for the stator. In embodiments, the outer diameter of the rotor is between about 11.8 cm and about 35 cm. In embodiments, the outer diameter of the stator is between about 15.4 cm and about 40 cm. Alternatively, the rotor and stator may have alternate diameters in order to alter the tip speed and shear pressures. In certain embodiments, each of three stages is operated with a super-fine generator, comprising a gap of between about 0.025 mm and about 3 mm.

High shear device 200 is fed a reaction mixture comprising the feed stream 205. Feed stream 205 comprises an emulsion of the dispersible phase and the continuous phase. Emulsion refers to a liquefied mixture that contains two distinguishable substances (or phases) that will not readily mix and dissolve together. Most emulsions have a continuous phase (or matrix), which holds therein discontinuous droplets, bubbles, and/or particles of the other phase or substance. Emulsions may be highly viscous, such as slurries or pastes, or may be foams, with tiny gas bubbles suspended in a liquid. As used herein, the term "emulsion" encompasses continuous phases comprising gas bubbles, continuous phases comprising particles (e.g., solid catalyst), continuous phases comprising droplets, or globules, of a fluid that is insoluble in the continuous phase, and combinations thereof.

Feed stream 205 may include a particulate solid catalyst component. Feed stream 205 is pumped through the generators 220, 230, 240, such that product dispersion 210 is formed. In each generator, the rotors 222, 223, 224 rotate at high speed relative to the fixed stators 227, 228, 229. The rotation of the rotors pumps fluid, such as the feed stream 205, between the outer surface of the rotor 222 and the inner surface of the stator 227 creating a localized high shear condition. The gaps 225, 235, 245 generate high shear forces that process the feed stream 205. The high shear forces between the rotor and stator functions to process the feed stream 205 to create the product dispersion 210. Each generator 220, 230, 240 of the high shear device 200 has interchangeable rotor-stator combinations for producing a narrow distribution of the desired bubble size, if feedstream 205 comprises a gas, or globule size, if feedstream 205 comprises a liquid, in the product dispersion 210.

The product dispersion 210 of gas particles, globules, or bubbles, in a liquid comprises an emulsion. In embodiments, the product dispersion 210 may comprise a dispersion of a previously immiscible or insoluble gas, liquid or solid into the continuous phase. The product dispersion 210 has an average gas particle, globule or bubble, size less than about 1.5 μm; preferably the globules are sub-micron in diameter. In certain instances, the average globule size is in the range from about 1.0 μm to about 0.1 μm. Alternatively, the average globule size is less than about 400 nm (0.4 μm) and most preferably less than about 100 nm (0.1 μm).

Tip speed is the velocity (m/sec) associated with the end of one or more revolving elements that is transmitting energy to the reactants. Tip speed, for a rotating element, is the circumferential distance traveled by the tip of the rotor per unit of time, and is generally defined by the equation $V\ (m/sec)=\pi \cdot D \cdot n$, where V is the tip speed, D is the diameter of the rotor, in meters, and n is the rotational speed of the rotor, in revolutions per second. Tip speed is thus a function of the rotor diameter and the rotation rate.

For colloid mills, typical tip speeds are in excess of 23 m/sec (4500 ft/min) and may exceed 40 m/sec (7900 ft/min). For the purpose of the present disclosure the term 'high shear' refers to mechanical rotor-stator devices, such as mills or mixers, that are capable of tip speeds in excess of 5 m/sec (1000 ft/min) and require an external mechanically driven power device to drive energy into the stream of products to be reacted. In certain instances, a tip speed in excess of 22.9 m/s (4500 ft/min) is achievable, and may exceed 225 m/s (44,200 ft/min). A high shear device combines high tip speeds with a very small shear gap to produce significant friction/shear on the material being processed. Accordingly, a local pressure in the range of about 1000 MPa (about 145,000 psi) to about 1050 MPa (152,300 psi) and elevated temperatures at the tip of the shear mixer can be produced during operation (depending on shear gap and tip speed and other factors). In certain embodiments, the local pressure is at least about 1034 MPa (about 150,000 psi). The local pressure further depends on the tip speed, fluid viscosity, and the rotor-stator gap during operation.

An approximation of energy input into the fluid (kW/l/min) may be made by measuring the motor energy (kW) and fluid output (l/min). In embodiments, the energy expenditure of a high shear device is greater than 1000 $W/m^3$. In embodiments, the energy expenditure is in the range of from about 3000 $W/m^3$ to about 7500 $W/m^3$. The high shear device 200 combines high tip speeds with a very small shear gap to produce significant shear on the material. The amount of shear is typically dependent on the viscosity of the fluid. The shear rate is the tip speed divided by the shear gap width (minimal clearance between the rotor and stator). The shear rate generated in high shear device 200 may be greater than 20,000 $s^{-1}$. In some embodiments, the shear rate is at least 40,000 $s^{-1}$. In some embodiments, the shear rate is at least 100,000 $s^{-1}$. In some embodiments, the shear rate is at least 500,000 $s^{-1}$. In some embodiments, the shear rate is at least 1,000,000 $s^{-1}$. In some embodiments, the shear rate is at least 1,600,000 $s^{-1}$. In embodiments, the shear rate generated by HSD 40 is in the range of from 20,000 $s^{-1}$ to 100,000 $s^{-1}$. For example, in one application the rotor tip speed is about 40 m/s (7900 ft/min); the shear gap width is 0.0254 mm (0.001 inch), producing a shear rate of 1,600,000 $s^{-1}$. In another application the rotor tip speed is about 22.9 m/s (4500 ft/min) and the shear gap width is 0.0254 mm (0.001 inch), producing a shear rate of about 901,600 $s^{-1}$. In embodiments where the rotor has a larger diameter, the shear rate may exceed about 9,000,000 $s^{-1}$.

The high shear device 200 produces a gas emulsion capable of remaining dispersed at atmospheric pressure for at least about 15 minutes. For the purpose of this disclosure, an emulsion of gas particles, globules or bubbles, in the dispersed phase in product dispersion 210 that are less than 1.5 μm in diameter may comprise a micro-foam. Not to be limited by a specific theory, it is known in emulsion chemistry that sub-micron particles, globules, or bubbles, dispersed in a liquid undergo movement primarily through Brownian motion effects.

Selection of the high shear device 200 is dependent on throughput requirements and desired particle or bubble size in the outlet dispersion 210. In certain instances, high shear device 200 comprises a Dispax Reactor® of IKA® Works, Inc. Wilmington, N.C. and APV North America, Inc. Wilmington, Mass. Model DR 2000/4, for example, comprises a belt drive, 4M generator, PTFE sealing ring, inlet flange 1" sanitary clamp, outlet flange ¾" sanitary clamp, 2HP power, output speed of 7900 rpm, flow capacity (water) approximately 300 l/h to approximately 700 l/h (depending on generator), a tip speed of from 9.4 m/s to about 41 m/s (about 1850 ft/min to about 8070 ft/min). Several alternative models are available having various inlet/outlet connections, horsepower, tip speeds, output rpm, and flow rate. For example, a Super Dispax Reactor DRS 2000. The RFB unit may be a DR 2000/50 unit, having a flow capacity of 125,000 liters per hour, or a DRS 2000/50 having a flow capacity of 40,000 liters/hour.

Without wishing to be limited to a particular theory, it is believed that the level or degree of high shear mixing is sufficient to increase rates of mass transfer and may produce localized non-ideal conditions that enable reactions to occur that would not otherwise be expected to occur based on Gibbs free energy predictions. Localized non-ideal conditions are believed to occur within the high shear device resulting in increased temperatures and pressures with the most significant increase believed to be in localized pressures. The increase in pressures and temperatures within the high shear device are instantaneous and localized and quickly revert to bulk or average system conditions once exiting the high shear device. In some cases, the high shear-mixing device induces cavitation of sufficient intensity to dissociate one or more of the reactants into free radicals, which may intensify a chemical reaction or allow a reaction to take place at less stringent conditions than might otherwise be required. Cavitation may also increase rates of transport processes by producing local turbulence and liquid microcirculation (acoustic streaming).

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, and so forth). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims that follow, that scope including all equivalents of the subject matter of the claims. The claims are incorporated into the specification as an embodiment of the present invention. Thus, the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent they provide exemplary, procedural, or other details supplementary to those set forth herein.

We claim:

1. A method for producing aerated fuels, comprising:

providing a high shear device having at least one rotor/stator set configured for producing a tip speed of at least 5 m/s, wherein the high shear device is configured with a second rotor and a second stator disposed therein, and wherein each of the second rotor and the second stator have a toothed surface;

introducing a gas and a liquid fuel into said high shear device; and forming an emulsion of the gas and the liquid fuel, wherein said gas comprises bubbles with an average diameter less than about 5 μm to form aerated fuel.

2. The method of claim 1 wherein forming an emulsion further comprises forming gas bubbles having an average diameter of less than about 1.5 μm in the high shear device.

3. The method of claim 1 wherein said high shear device is configured to produce a localized pressure of at least about 1000 MPa at the tip.

4. The method of claim 1 including subjecting said liquid fuel and gas bubbles to a shear rate of greater than about 20,000_$s^{-1}$.

5. The method of claim 1 wherein said high shear device is configured for an energy expenditure of at least 1000 $W/m^3$.

6. The method of claim 1 wherein said emulsion comprises a mixture of liquid fuel and gas greater than about the upper explosive limit (UEL) of the liquid fuel.

7. The method of claim 1 wherein the emulsion comprises a microfoam of aerated fuel.

8. The method of claim 1 wherein introducing a gas and a liquid fuel comprises pressurizing the liquid fuel.

9. The method of claim 8 wherein pressurizing the liquid fuel comprises a pressure of at least about 203 kPa (2 atm).

10. The method of claim 1 further comprising:

injecting the aerated fuel into an internal combustion engine; and combusting the aerated fuel to produce mechanical force.

11. The method of claim 10, wherein injecting the aerated fuel further comprises including an oxidant gas at a stoichiometric ratio.

12. The method of claim 11 wherein injecting the aerated fuel further comprises introducing the emulsion into the internal combustion engine in a stoichiometric excess.

13. The method of claim 1 wherein the gas comprises at least one chosen from the group consisting of air, water vapor, methanol, nitrous oxide, propane, nitromethane, oxalate, organic nitrates, acetone, kerosene, toluene, or Methyl-cyclopentadienyl manganese tricarbonyl.

14. A system for the production of aerated fuels, comprising;

a pump positioned upstream of a high shear device, the pump in fluid connection with a high shear device inlet, wherein said high shear device comprises at least one generator comprising a rotor and a complementarily-shaped stator, and wherein the high shear device produces an emulsion of gas in fuel, the emulsion having an average bubble diameter of less than about 1.5 μm; and an engine configured for the combustion of the emulsion.

15. The system of claim 14 wherein the engine is an internal combustion engine.

16. The system of claim 14 wherein said high shear device is configured to produce a shear rate of greater than about 20,000_$s^{-1}$, and wherein each of the rotor and the complimentary-shaped stator have a toothed surface.

* * * * *